US005967359A

United States Patent [19]

Mindell

[11] Patent Number: 5,967,359

[45] Date of Patent: Oct. 19, 1999

[54] RECEPTACLE

[76] Inventor: Bertram Mindell, 17 Beaufort Rd, Ealing, United Kingdom, W5 3EB

[21] Appl. No.: 08/871,634

[22] Filed: Jun. 9, 1997

Related U.S. Application Data

[63] Continuation of application No. PCT/GB95/02789, Nov. 30, 1995, abandoned.

[30] Foreign Application Priority Data

Jul. 12, 1994 [GB] United Kingdom ..... 9424646
Aug. 24, 1995 [GB] United Kingdom ..... 9517360

[51] Int. Cl.[6] ..... B65F 1/12

[52] U.S. Cl. ..... 220/475; 220/478; 248/146; 248/907

[58] Field of Search ..... 220/475, 478, 220/908; 248/146, 907

[56] References Cited

U.S. PATENT DOCUMENTS

| | | | |
|---|---|---|---|
| 750,742 | 1/1904 | Weston | 220/475 |
| 2,613,010 | 10/1952 | Atkinson | 220/475 |
| 4,597,221 | 7/1986 | Adair et al. . | |
| 4,920,897 | 5/1990 | Reed et al. . | |
| 5,067,626 | 11/1991 | Leumi | 220/475 |
| 5,335,803 | 8/1994 | O'Brien et al. . | |
| 5,392,943 | 2/1995 | Delatte et al. | 220/475 |

FOREIGN PATENT DOCUMENTS

| | | |
|---|---|---|
| 2729880 | 1/1979 | Germany . |
| 2246291 | 1/1992 | United Kingdom . |
| 2257624 | 1/1993 | United Kingdom . |

*Primary Examiner*—Joseph M. Moy
*Attorney, Agent, or Firm*—Jacobson, Price, Holman & Stern, PLLC

[57] ABSTRACT

A receptacle (1) which may contain food or drinks or may be a plant container, for example, is provided with an upright central locating tube (2) which is attached to an aperture in a recess (3) in its base and is mounted on e.g. a parasol pole (6) by means of a jubilee clip (5) which encircles and grips spring fingers (4) which extend from the bottom end of the locating tube. The above clamping arrangement is concealed within the recess (3) and hence the appearance is enhanced. In a further embodiment, the spring fingers are omitted and the locating tube is provided with apertures above and below the surrounding region of the base which enable the receptacle to be attached to the supporting pole by pegs or threaded fixing means and, when the receptacle is dismounted from the pole, function as drainage and/or ventilation holes.

20 Claims, 3 Drawing Sheets

RECEPTACLE

The present application is a continuation of PCT/GB95/02789 filed Nov. 30, 1995, now abandoned.

The present invention related to a receptacle which can be supported on an upright member. The receptacle may for example be a flat dish, a shaped dish, a bowl, a vase, a planter, a plant pot, a napkin holder, a condiment holder, an ice-bucket or a bird bath.

The invention relates particularly but not exclusively to a receptacle which can be supported on a parasol pole or umbrella pole.

Patio tables and larger tables used in cafes, beer gardens and at garden parties are generally provided with a hole in the top surface, usually in the centre of the table, to receive the pole of a parasol.

It would be desirable to provide a receptacle for such tables which could be located in the centre of the table, making use of an area of the table which is sometimes difficult to reach.

GB 2,246,291A discloses such a tray for use with an umbrella or parasol, the tray having a central aperture in its base which is attached to a supporting tube extending downwardly towards an aperture in a table. The lower end of the tube is fixed to the aperture in the table and the parasol or umbrella pole extends upwardly through the aperture in the table and through the tube and projects upwardly from the aperture in the tray.

However the above arrangement can only be used with tables having an aperture of a size corresponding to the diameter of the tube and furthermore the height of the tray is fixed in relation to the height of the table. Moreover parasol poles are used not only in conjunction with a patio table or garden table but also in a free-standing manner for example in purpose-built bases or supported in soil or sand. The above tray arrangement is unsuitable for use with a free-standing pole.

Accordingly the present invention provides a receptacle having an aperture formed in a recess in the underside of its base, an upright locating tube extending from and having its bore aligned with said aperture, said locating tube having supporting means arranged to engage an upright receptacle-supporting member extending through said locating tube whereby said receptacle can be supported in an elevated position by said receptacle-supporting member, the upper end of said locating tube being located above the base.

Preferably said supporting means is located within and concealed by said recess.

Preferably said supporting means is removable from said locating tube.

Preferably the upright locating tube projects below at least the highest part of the base.

The supporting means may be separate from or integral with the locating tube, and preferably comprises a clamp which may be mounted either on the locating tube or on the parasol pole or other upright receptacle-supporting member, for example.

The locating tube is conveniently moulded integrally with the base of the receptacle but alternatively a separate locating tube can be used.

In a preferred embodiment said supporting means and tube do not extend beneath the lowest portion of the base whereby the receptacle can be supported on a flat surface, i.e. quite independently of any supporting pole.

The receptacle is conveniently made of plastics material e.g. polypropylene but it is envisaged that other materials such as china, porcelain, terracotta, earthenware, pottery, wood, metal or glass may alternatively be used.

The invention also encompasses an umbrella or parasol having the receptacle of the invention supported on its pole.

Preferred embodiments of the invention are described below by way of example only with reference to FIGS. 1 to 7 of the accompanying drawings, wherein:

FIG. 1 is an elevation, partly in section of one receptacle in accordance with the invention, FIG. 2 is an elevation, partly in section, of another receptacle in accordance with the invention, FIG. 2A is an elevation, partly in section, showing a variant of the clamping arrangement of FIG. 2, FIG. 3 is an elevation showing a parasol provided with a receptacle in accordance with the invention, FIG. 4 is an elevation, partly in section of a further receptacle in accordance with the invention, supported on a flat surface;

Figure 1:
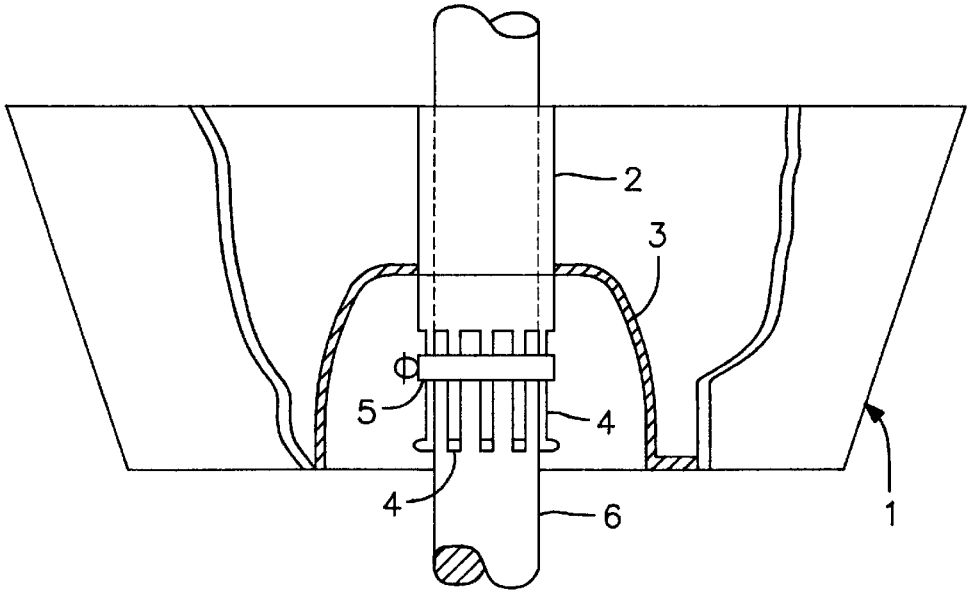

Referring to FIG. 1, the illustrated receptacle 1 is shown partly cut away to reveal a recess 3 in its base, which accommodates an integral locating tube 2 which is fitted through an aperture in the centre of the recess and extends upwardly to the open top of the receptacle. The locating tube 2 terminates in resilient spring fingers 4 which are urged against an upright supporting pole 6 by a Jubilee® clip 5. The distal tips of the spring fingers 4 project radially outwardly and thereby prevent the Jubilee® clip from slipping off when it is unfastened.

The locating tube 2 and main body of the receptacle 1 are formed from suitable plastics material such a polypropylene although other materials may be employed, particularly for the locating tube 2, in order to provide the required friction and resilience.

The locating tube 2 and especially its spring finger portion may optionally be lined with suitable gripping material such as rubber or the like in order to enable the receptacle to be securely located without damaging the surface of the supporting pole 6. Replacable sleeves of gripping material may be provided in a variety of thickness in order to allow a locating tube of standard size to engage with upright receptacle-supporting members of various diameters and profiles. It will be apparent that the described clamping arrangement is effectively concealed by the recess 3, thereby enhancing the appearance of the receptacle, which will normally be located below eye level and may contain food or drink, flowers, or soil and plants for example.

As an alternative or in addition to the clamping arrangement shown in FIG. 1 a similar Jubilee® clip may be fitted around the upper portion of locating tube 2 within the receptacle, and this may be hidden from view by the contents (e.g. soil) of the receptacle.

Figure 2:
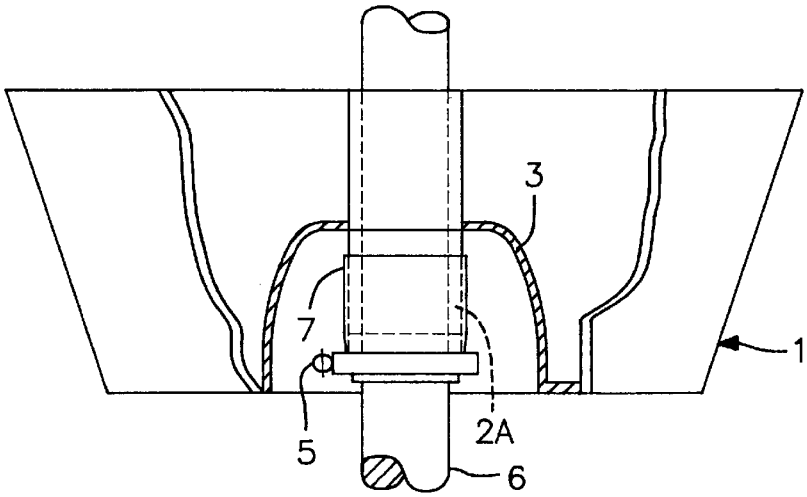

FIG. 2 shows a variant in which the spring fingers 4 are replaced by a recessed portion 2A of the locating tube 2 and a sleeve 7 of flexible material (preferably rubber or other elastomeric material) fitted round this recessed portion protrudes from the lower end of the locating tube. The protruding end of this sleeve is clamped around supporting pole 6 by a Jubilee® clip 5. This arrangement is specially suitable for supporting receptacles having integral locating tubes of relatively brittle material such as porcelain or terracotta for example.

Figure 2A:
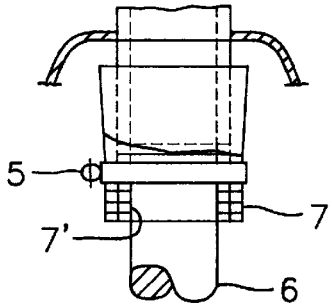

In the variant shown in FIG. 2A the sleeve 7 is attached to an inner sleeve portion 7' which is located beneath the lower end of the locating tube. The wall thickness of inner sleeve portion 7' is similar to that of the locating tube and hence the strain on the sleeve 7 is reduced in comparison with the arrangement shown in FIG. 2.

In some cases a sufficiently secure fixing may be achieved merely by clamping a clamp (such as a jubilee clip for example) around a sleeve fitted around the supporting pole and resting the lower end of the locating tube on the upper surface of this sleeve.

A lid (not shown) having a slot to enable it to be fitted around the parasol pole may also be provided in order to protect the contents of the receptacle.

In another embodiment (not shown) the receptacle may be in the form of a dish or tray with one or more cut-out portions in its edge which are adapted to receive and retain wineglasses or other receptacles for food or drink.

Figure 3:
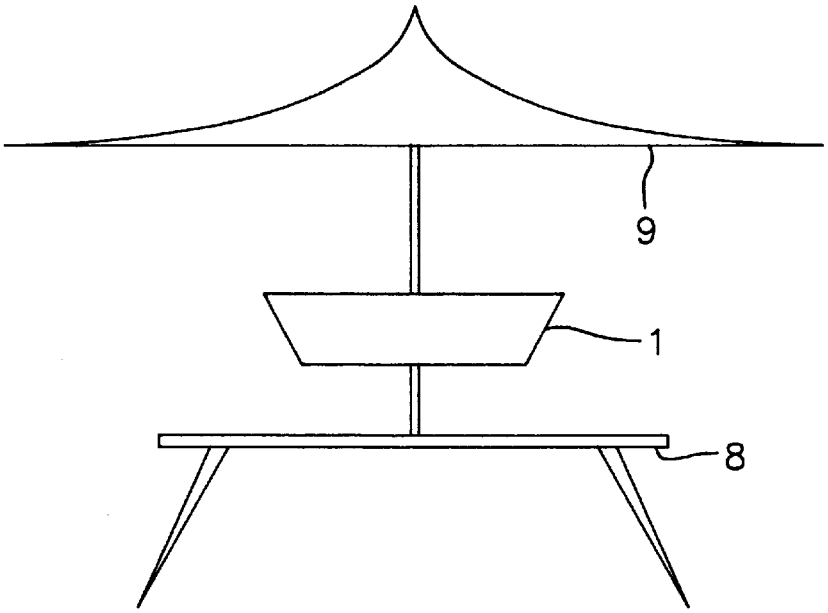

FIG. 3 shows a receptacle 1 (as described with reference to FIG. 1 or FIG. 2 for example) supported on the supporting pole 6 of a parasol 9, the supporting pole extending through a central aperture in a table 8. It will be apparent that the receptacle 1 is protected against theft because it can only be removed by lifting the parasol 9 and/or its pole 6.

This feature of the invention is especially advantageous in situations where the receptacle is exposed in public places. In particular it is envisaged that the receptacle of the invention may be provided with an enlarged locating tube enabling it to be fitted over a large pole such as lamppost for example.

Figure 4:
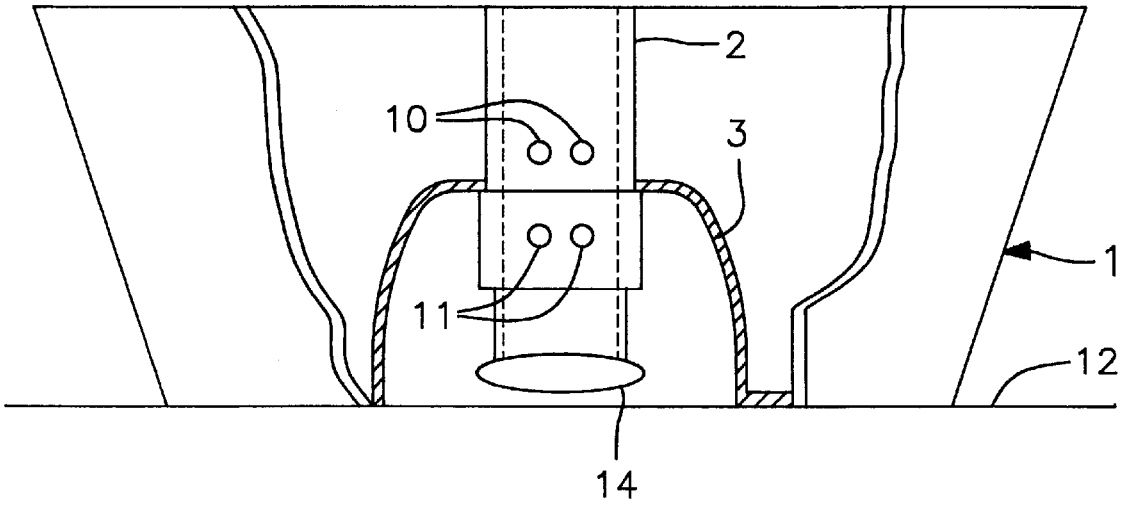

FIG. 4 shows a receptacle 1 in accordance with the invention wherein the locating tube 2 is provided with upper apertures 10 and lower apertures 11 above and below the adjoining region of the base respectively. Pegs or threaded fixing means (not shown) can be inserted through apertures 10 and/or apertures 11 to engage holes in the supporting pole (not shown) or to screw into the supporting pole.

However in FIG. 4 the receptacle is shown supported on a flat surface 12 rather than being mounted on a pole, and accordingly the lower end of tube 2 is capped with a cap 14 which is suitably formed from resilient plastics material. Alternatively the upper end of tube 2 may be capped.

The apertures 10 also enable water to drain from the receptacle and also provide a degree of ventilation. It will be appreciated that several apertures may be provided e.g. in a circular array for this purpose. Such a receptacle is particularly suitable for use as a planter.

Figure 5:
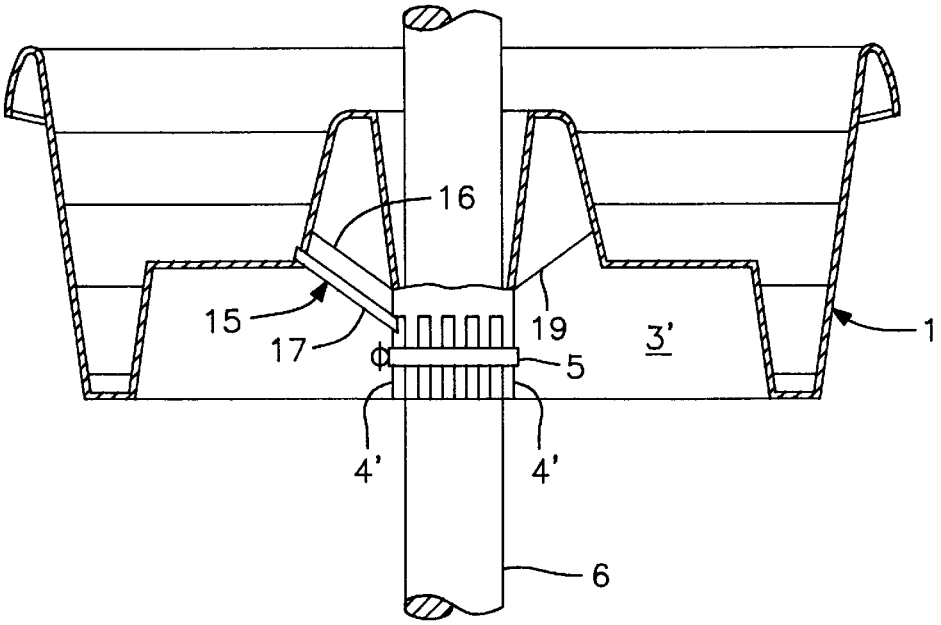
FIG. 5 is an elevation, partly in section, of a further embodiment of the invention.

Referring to FIG. 5, the pot 1' is intended to be used as a planter and is suitably formed of injection-moulded polypropylene and has a ribbed exterior as shown. A stepped recess 3' has its inner portion supported by four regularly spaced radial webs 19 (only two of which are visible in FIG. 5) and the innermost portion of the pot wall is generally frusto-conical and terminates in an integral array of spring fingers 4' which are urged against supporting pole 6 by a jubilee clip 5. The pot is filled with soil (not shown). The webbed inner portion of the receptacle separates the soil (not shown) in the receptacle from the pole 6. In particular there is a space in the region between the innermost frusto-conical portion of the receptacle and the pole 6.

Figure 6:
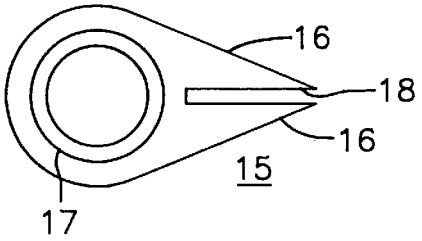
FIG. 6 is an end elevation of a drainage tube for use in the arrangement of FIG. 5.

A drainage tube 15 is provided as a separate part and comprises a plastic tube 17 moulded integrally with two fingers 16 which are of generally triangular cross-section as shown in FIG. 6. These grip the underside of one of the webs 19 which fits into a slot 18 between them. In this position, as shown in FIG. 5, the plastic tube 17 has its upper, radially outer end fitted through an aperture in a edge of the pot and its lower, radially inner end fitted between two adjacent spring fingers 4'. Hence any excess water in the soil drains away to the surface of the parasol pole and runs down through the hole of a table (not shown) without spilling onto the table surface.

Figure 7:
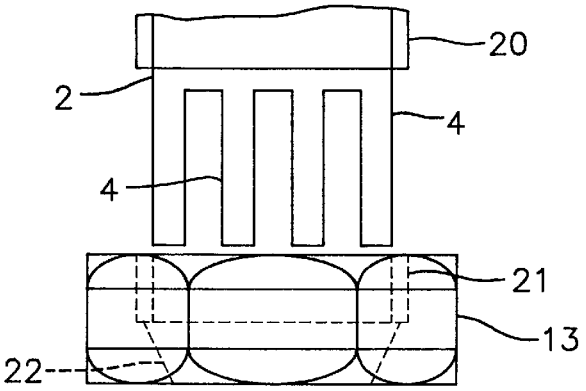
FIG. 7 is an elevation of a screwing arrangement in a further embodiment.

In the variant shown in FIG. 7, a nut 13, suitably of polyamide, has an upper threaded bore portion 21 which can screw onto an external threaded portion 20 of locating tube 2 and, when screwed on to the locating tube, urges the array of spring fingers 4 against the parasol pole 6 by means of an unthreaded lower tapered portion 22 and thereby supports the pot by frictional engagement of the spring fingers with the parasol pole.

I claim:

1. A receptacle comprising a base, said base having a recess in an underside thereof, an aperture formed in said recess, an upright locating tube extending from and having its bore aligned with said aperture, said locating tube carrying exterior supporting means for engaging an upright receptacle-supporting member extending through said locating tube whereby said receptacle can be supported in an elevated position by said receptacle-supporting member.

2. A receptacle according to claim 1 wherein said supporting means is located within and concealed by said recess.

3. A receptacle as claimed in claim 1 wherein said supporting means is removable from said locating tube.

4. A receptacle as claimed in claim 1 wherein said supporting means comprises a clamping arrangement which in use attaches said locating tube to said upright receptacle-supporting member.

5. A receptacle as claimed in claim 4 wherein said tube carries resilient spring fingers extending downwardly therefrom and said clamping arrangement comprises a generally circular clamp for tightening around said resilient spring fingers.

6. A receptacle as claimed in claim 4 wherein said clamping arrangement is located above the base of the receptacle and clamps the locating tube against said upright receptacle-supporting member.

7. A receptacle as claimed in claim 5 wherein said clamping arrangement is located above the base of the receptacle and clamps the locating tube against said upright receptacle-supporting member.

8. A receptacle as claimed in claim 5 wherein said locating tube has an external threaded portion and said clamping arrangement comprises a nut for screwing onto said threaded portion to urge the spring fingers radially inwards.

9. A receptacle as claimed in claim 4 wherein said locating tube is provided with gripping material on its inner surface.

10. A receptacle as claimed in claim 4 wherein said clamping arrangement comprises a sleeve of elastomeric material which engages said tube and grips said upright receptacle-supporting member.

11. A receptacle as claimed in claim 10, further comprising a generally circular clamp for tightening around a portion of said sleeve which extends beyond said tube to grip said upright receptacle-supporting member.

12. A receptacle as claimed in claim 1 wherein said supporting means comprises at least one aperture in said locating tube through which are fitted one or more peg means.

13. A receptacle as claimed in claim 1 wherein said supporting means comprises a sleeve fitted around said receptacle-supporting member and said locating tube rests on the upper end of said sleeve.

14. A receptacle as claimed in claim 1 wherein said supporting means and tube are above the lowest portion of the base whereby the receptacle can be supported on a flat surface.

15. A receptacle as claimed in claim 14 further comprising a cap fitted to an end of said tube.

16. A receptacle as claimed in claim 1 wherein said locating tube extends upwardly from the base towards the mouth of the receptacle.

17. A receptacle as claimed in claim 1 wherein said locating tube is moulded integrally with the base of the receptacle.

18. A receptacle as claimed in claim 1 wherein at least one cut-out portion is provided at an edge thereof for supporting a receptacle for food or drink.

19. A receptacle as claimed in claim 1 wherein at least one drainage aperture is provided in said locating tube above the level of the base.

20. A parasol arrangement comprising an upright supporting pole, a canopy supported on said pole and a receptacle supported on said pole below said canopy, said receptacle having a base, a recess being formed in an underside of said base, an aperture being formed in said recess, an upright locating tube extending from and having its bore aligned with said aperture, said pole extending through said locating tube and said locating tube carrying exterior supporting means for engaging said pole whereby said receptacle can be supported in an elevated position by said receptacle-supporting member, said locating tube having an upper end located above said base.

* * * * *